US012765735B2

(12) United States Patent
Sun et al.

(10) Patent No.: US 12,765,735 B2
(45) Date of Patent: Oct. 20, 2026

(54) ROBOT CLEANER

(71) Applicant: LG ELECTRONICS INC., Seoul (KR)

(72) Inventors: Changhwa Sun, Seoul (KR); Jungmin Ko, Seoul (KR); Jihyun Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 910 days.

(21) Appl. No.: 17/918,688

(22) PCT Filed: Nov. 11, 2020

(86) PCT No.: PCT/KR2020/015783
§ 371 (c)(1),
(2) Date: Oct. 13, 2022

(87) PCT Pub. No.: WO2021/210746
PCT Pub. Date: Oct. 21, 2021

(65) Prior Publication Data

US 2023/0093456 A1 Mar. 23, 2023

(30) Foreign Application Priority Data

Apr. 13, 2020 (KR) ..... 10-2020-0044586

(51) Int. Cl.
*A47L 11/30* (2006.01)
*A47L 11/40* (2006.01)

(52) U.S. Cl.
CPC ..... *A47L 11/30* (2013.01); *A47L 11/4047* (2013.01); *A47L 11/4083* (2013.01); *A47L 11/4088* (2013.01); *A47L 2201/00* (2013.01)

(58) Field of Classification Search
CPC .. A47L 11/30; A47L 11/4047; A47L 11/4083; A47L 11/4088; A47L 2201/00; A47L 11/29; A47L 2201/04
See application file for complete search history.

(56) References Cited

U.S. PATENT DOCUMENTS

2018/0184870 A1* 7/2018 Moon et al. ..... A47L 11/187 15/98
2019/0290089 A1* 9/2019 Johnson et al. ..... A47L 11/305 15/320

FOREIGN PATENT DOCUMENTS

CN 2461473 Y 11/2001
CN 104645709 A 4/2015
CN 204863023 U 12/2015
KR 20120129185 A * 11/2012 ..... A47L 11/28
KR 20160008855 A * 1/2016 ..... A47L 11/14
(Continued)

*Primary Examiner* — Patrick D Maines
(74) *Attorney, Agent, or Firm* — Birch, Stewart, Kolasch & Birch, LLP

(57) ABSTRACT

Provided is a robot cleaner including a main body for forming an exterior of the robot cleaner, a driver for moving the main body, a cleaning module housing coupled to the main body, and a mopping unit accommodated in a space defined in the cleaning module housing to mop a traveling face, wherein the mopping unit includes a body disposed in the cleaning module housing, a plurality of mopping rollers arranged on the body, and a mop disposed to surround the body and the plurality of mopping rollers and in a surface contact with the traveling face. An area in contact with the traveling face is increased, so that a cleaning efficiency may be maximized.

13 Claims, 6 Drawing Sheets

(56) References Cited

FOREIGN PATENT DOCUMENTS

| | | | | | |
|---|---|---|---|---|---|
| KR | 10-2017-0034362 | A | | 3/2017 | |
| KR | 20170034362 | A | * | 3/2017 | ..... A47L 11/201 |
| KR | 10-2018-0079070 | A | | 7/2018 | |

* cited by examiner

[Fig. 2]
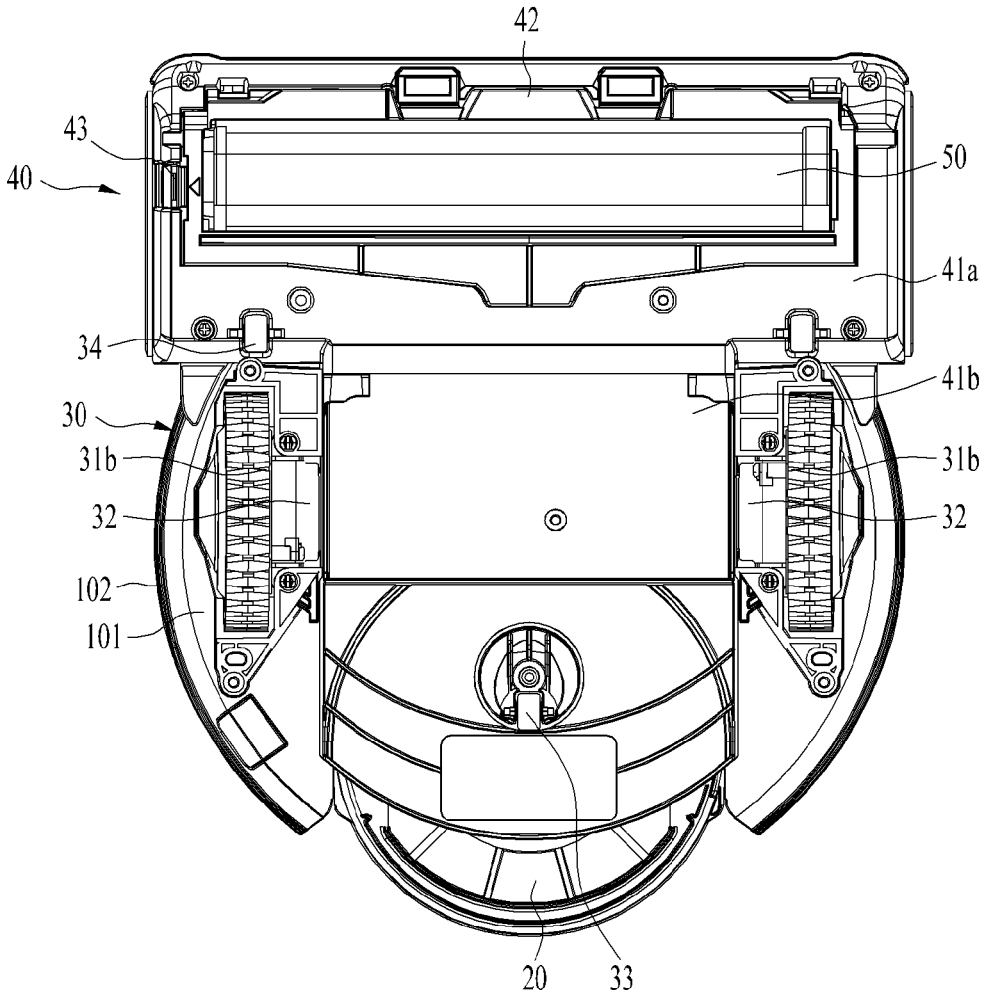
[Fig. 3]
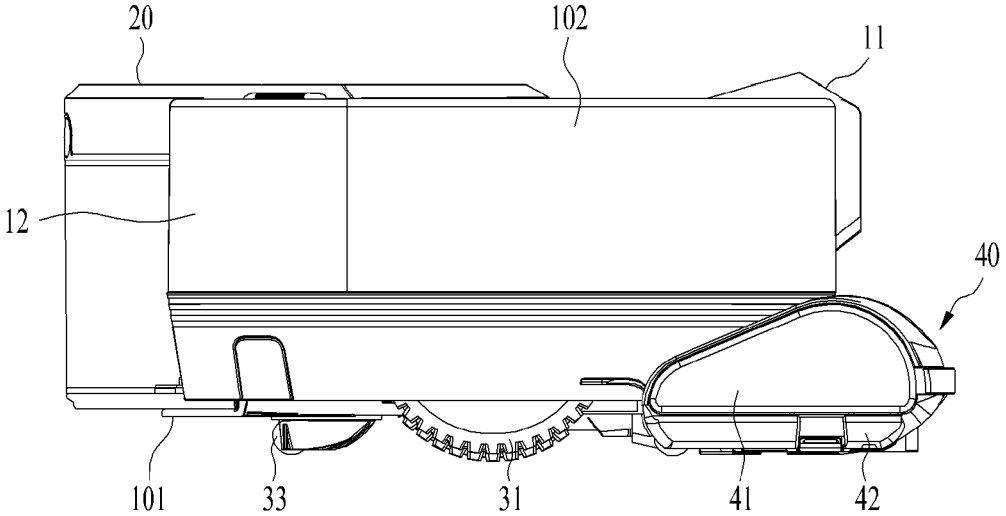

[Fig. 4]
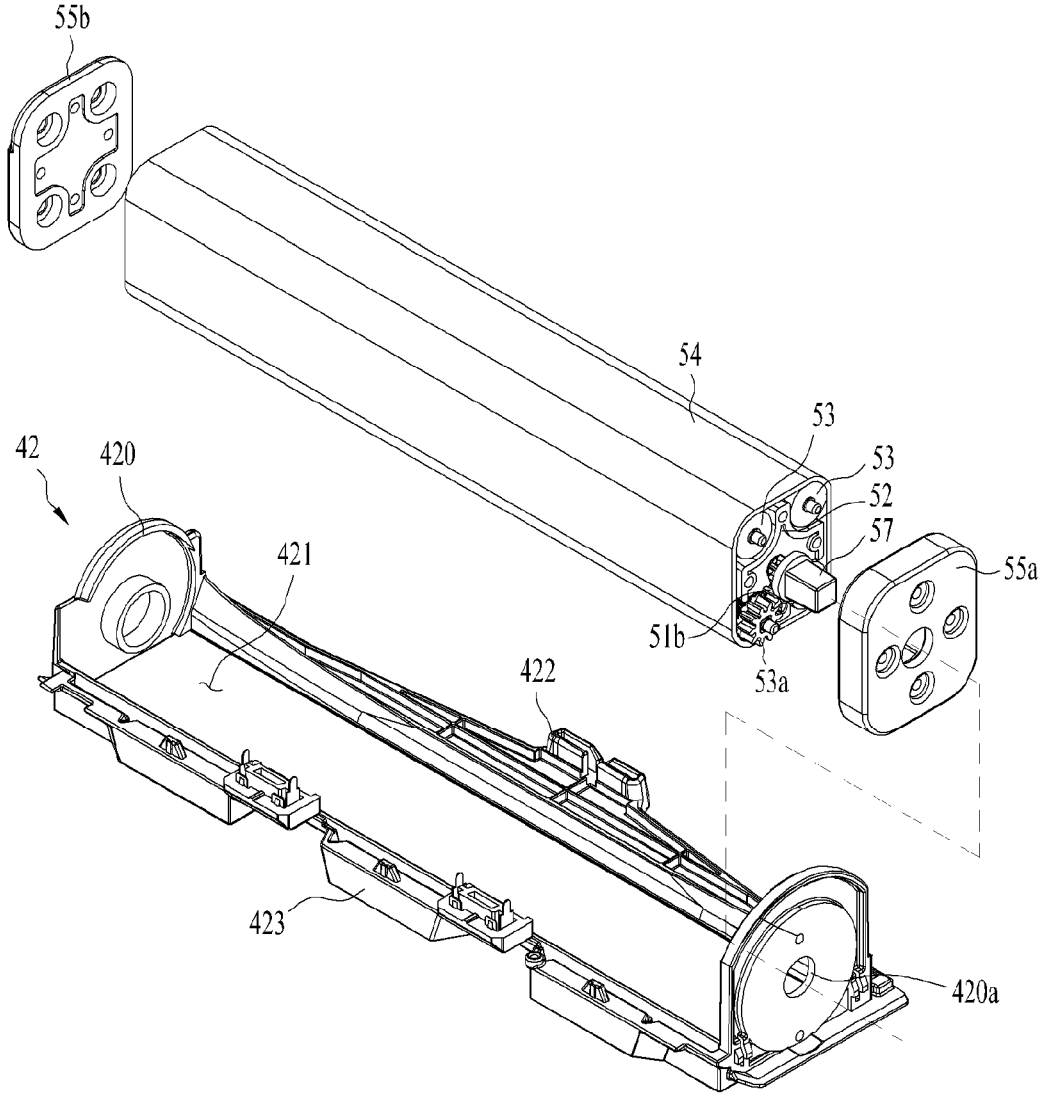

[Fig. 5]
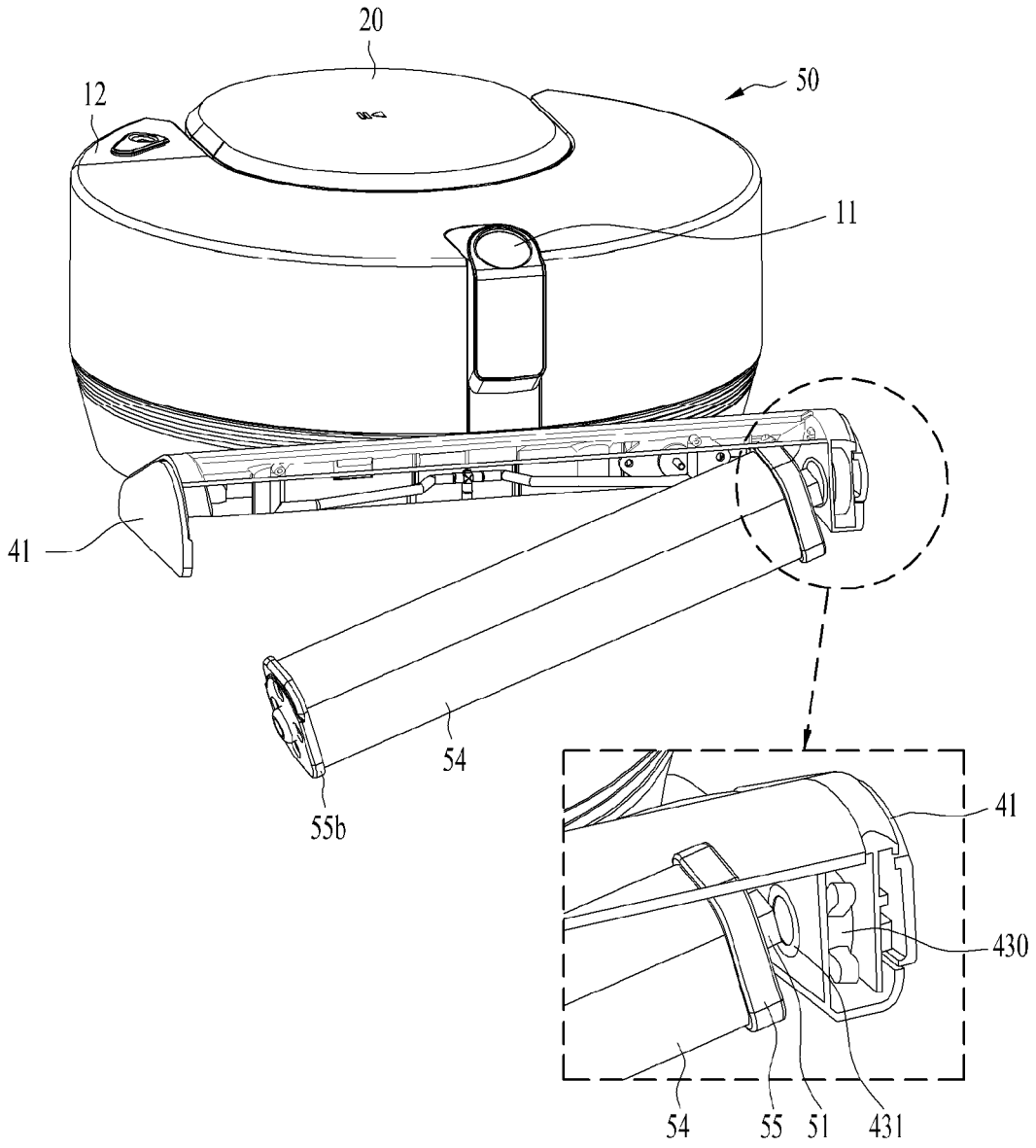

[Fig. 6]
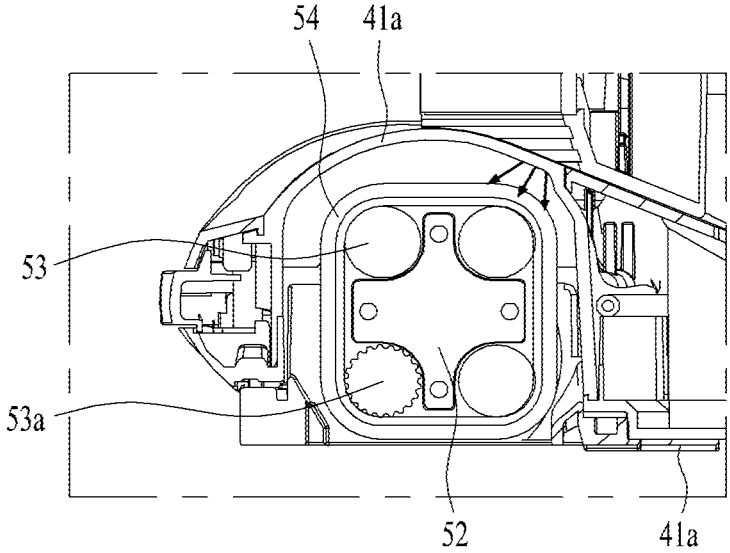
[Fig. 7]
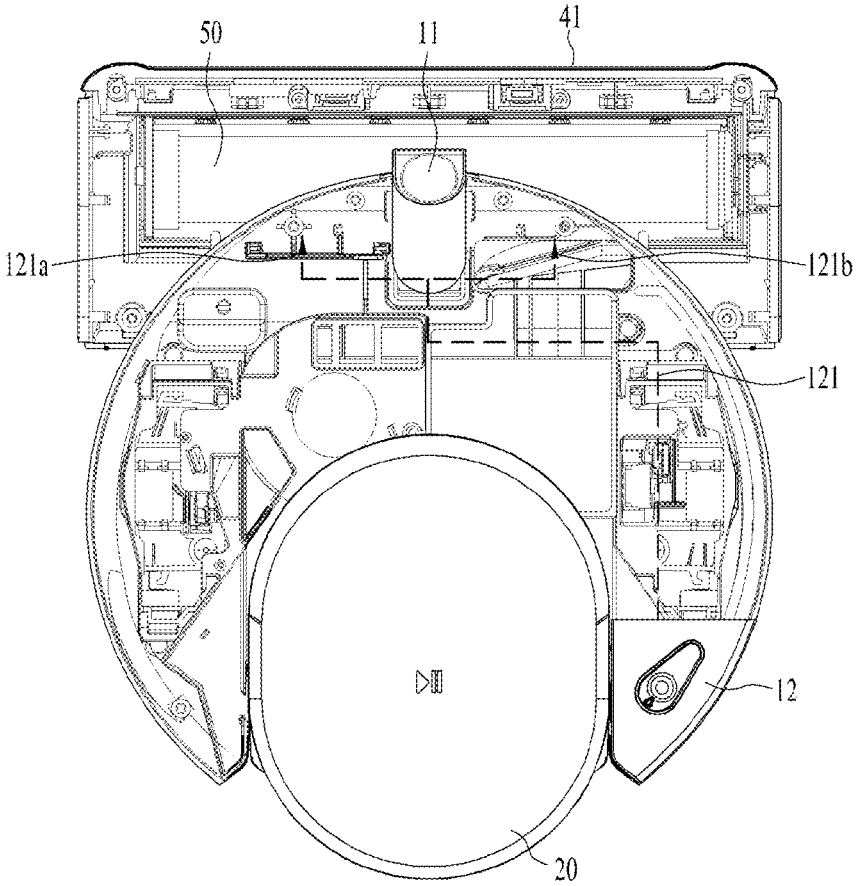

[Fig. 8]
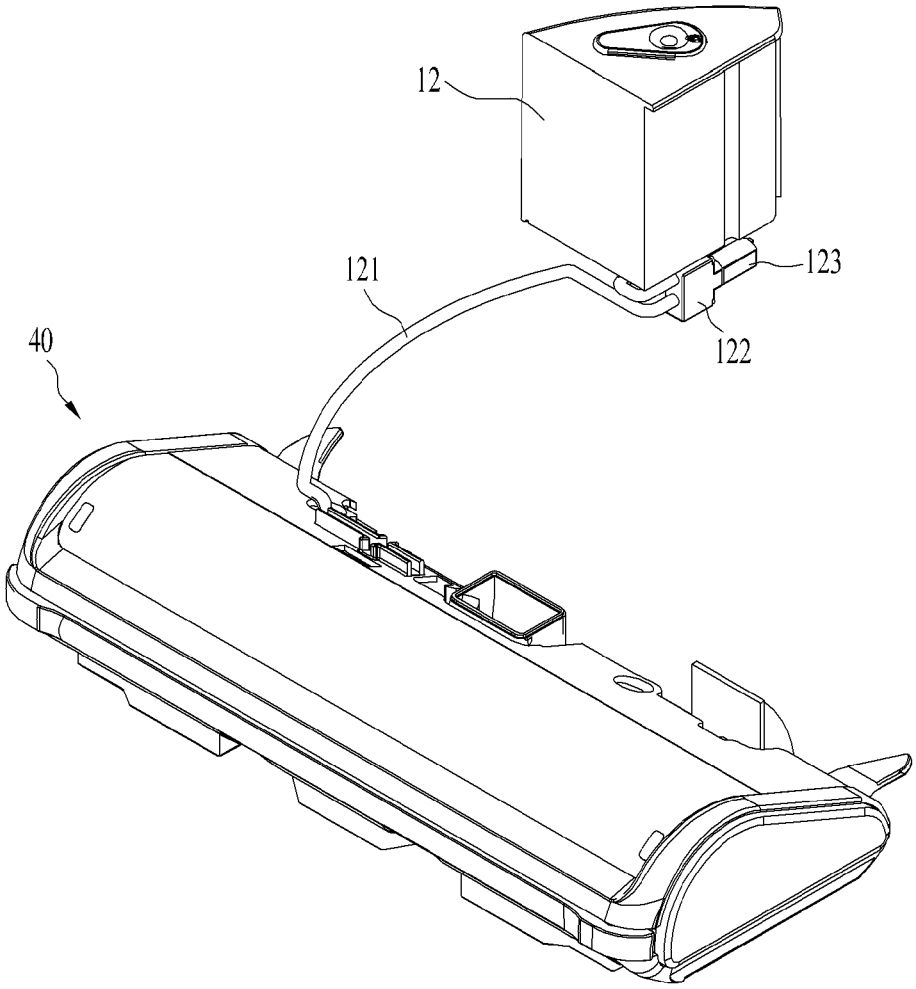

ROBOT CLEANER

CROSS REFERENCE TO RELATED APPLICATIONS

This application is the National Phase of PCT International Application No. PCT/KR2020/015783, filed on Nov. 11, 2020, which claims priority under 35 U.S.C. 119(a) to Patent Application No. 10-2020-0044586, filed in the Republic of Korea on Apr. 13, 2020, all of which are hereby expressly incorporated by reference into the present application.

TECHNICAL FIELD

The present disclosure relates to a robot cleaner.

BACKGROUND ART

A person cleans a living space thereof for hygiene and cleanliness. There are many reasons for the cleaning. For example, the cleaning may be done to protect a body from disease or to prevent damage to a bronchus. Further, the cleaning may be done for a quality of life, such as, for using the space thereof in a clean state.

Dust or foreign substances settle on a floor by gravity. Thus, in order to perform the cleaning, people tend to bend their waists or sit down, so that it is easy to put a strain on the waists or joints.

To this end, in recent years, cleaners that help people clean have appeared. The cleaners may be roughly classified into a handy stick cleaner, a bar-type cleaner, a robot cleaner, and the like.

Among these, the robot cleaner cleans the space instead of a user in a specific space such as a home, an office, or the like. The robot cleaner generally performs the cleaning by sucking dust in an area to be cleaned.

However, it may not be said that the cleaning is completed by just sucking the dust. The reason is that there is dust that is not able to be removed only by a suction power of the robot cleaner. For example, a foreign substance attached to a floor face or dust larger than a suction tube of the robot cleaner are difficult to be removed with only the suction power of the robot cleaner.

According to Chinese Patent No. 104545707, a robot cleaner in which a roller mop mops a floor face is disclosed. However, even in the patent document, there is no specific disclosure about a method for increasing an area of contact with the floor.

DISCLOSURE OF INVENTION

Technical Problem

According to an embodiment, it is intended to provide a robot cleaner that may mop a floor face or a traveling face as well as suck dust when cleaning an area to be cleaned.

Further, it is intended to provide a robot cleaner including a mopping unit capable of being in a surface contact in a caterpillar scheme, not a mopping nozzle including a roller in a line contact scheme.

Further, it is intended to provide a robot cleaner that may maximize an area of a floor face to be mopped.

Further, it is intended to provide a robot cleaner that is prevented from entering a special environment such as a carpet and the like.

Further, it is intended to provide a robot cleaner that may supply water to a mop.

Solution to Problem

As an example for solving the above-described problem, a mop roller may be formed in a caterpillar scheme. As the caterpillar scheme is used, a robot cleaner in which the mop roller is formed in a rectangular shape rather than a cylindrical shape to maximize an area in contact with a floor face is provided.

More specifically, a robot cleaner including a main body for forming an exterior of the robot cleaner, a driver for moving the main body, a cleaning module housing coupled to the main body, and a mopping unit accommodated in a space defined in the cleaning module housing to mop a traveling face, wherein the mopping unit includes a body disposed in the cleaning module housing, a plurality of mopping rollers arranged on the body, and a mop disposed to surround the body and the plurality of mopping rollers and in a surface contact with the traveling face is provided.

Further, there is provided the robot cleaner further including a water tank for receiving water therein, wherein the water tank is coupled to the main body, and a water supply passage connected to the water tank and the cleaning module housing to guide water received in the water tank.

Further, there is provided the robot cleaner in which the water supply passage is disposed to guide water to an internal space of the cleaning module housing, and the water supply passage and the cleaning module housing are in communication with each other in at least one location.

Further, there is provided the robot cleaner further including a pump for guiding water received in the water tank to the cleaning module housing, and a pump motor for operating the pump, wherein the pump and the pump motor are connected to the main body.

Further, there is provided the robot cleaner in which the body extends in a crosswise direction from a rotation center thereof.

Further, there is provided the robot cleaner in which the mopping rollers are respectively arranged in spaces divided by the body.

Further, there is provided the robot cleaner in which at least one of the plurality of mopping rollers is disposed to rotate the mop.

Further, there is provided the robot cleaner in which each mopping roller is disposed between two neighboring extended faces among extended faces of the body.

Further, there is provided the robot cleaner in which the mopping rollers are spaced apart from each other.

Further, there is provided the robot cleaner in which the mopping rollers are arranged such that centers of the mopping rollers are positioned on line segments of a virtual square.

Further, there is provided the robot cleaner further including a mopping unit receiving portion coupled to the cleaning module housing, wherein the mopping unit receiving portion seats the mopping unit therein, and a mopping unit driver disposed in the cleaning module housing, wherein the mopping unit driver operates the mopping unit.

Further, there is provided the robot cleaner in which the mopping unit includes a mopping shaft disposed to penetrate the mopping unit receiving portion to receive a driving power for rotating the mop, and the mopping shaft is connected to the mopping unit driver to receive the power to rotate the mop.

Further, there is provided the robot cleaner in which a first gear rotated integrally with the mopping shaft is directly connected to a mopping roller for rotating the mop among the plurality of mopping rollers or is connected to a second gear connected to the mopping roller for rotating the mop among the plurality of mopping rollers.

Further, there is provided the robot cleaner further including a controller configured to determine whether to operate the mopping unit driver and whether to guide water received in the water tank, wherein the mopping unit receiving portion includes a mop sensing portion for sensing whether the mop is mounted, and wherein water received in the water tank is controlled to be sprayed toward the mop when the mop is mounted.

Further, there is provided the robot cleaner in which the mopping unit receiving portion includes a climbing preventing portion extending forward of the cleaning module housing to prevent the robot cleaner from moving to a stepped terrain.

Further, there is provided the robot cleaner in which the climbing preventing portion extends from a face of the mopping unit receiving portion facing the traveling face in a direction of travel.

Further, there is provided the robot cleaner in which a plurality of climbing preventing portions are arranged.

Advantageous Effects of Invention

The robot cleaner according to an embodiment may mop the traveling face while sucking the dust from the area to be cleaned.

Further, the robot cleaner may be in the surface contact with the traveling face to secure an area in contact with the traveling face as much as possible.

Further, the robot cleaner may be prevented from entering a stepped terrain or an area where the mopping is not required, thereby performing effective cleaning.

Further, the robot cleaner absorbs moisture as well as simply mops the traveling face, so that a mopping performance thereof is excellent.

BRIEF DESCRIPTION OF DRAWINGS

FIG. 2 is a bottom view of a robot cleaner according to an embodiment.

FIG. 3 is a side view of a robot cleaner according to an embodiment.

FIG. 4 is a view showing a mopping unit of a robot cleaner according to an embodiment.

FIG. 5 is a view showing a connection relationship of a mopping unit of a robot cleaner according to an embodiment.

FIG. 6 is a cross-sectional view of a cleaning module according to an embodiment.

FIG. 7 is a view showing a water supply passage of a robot cleaner according to an embodiment.

FIG. 8 is a view of a water supply structure of a robot cleaner according to an embodiment.

MODE FOR THE INVENTION

Figure 1:
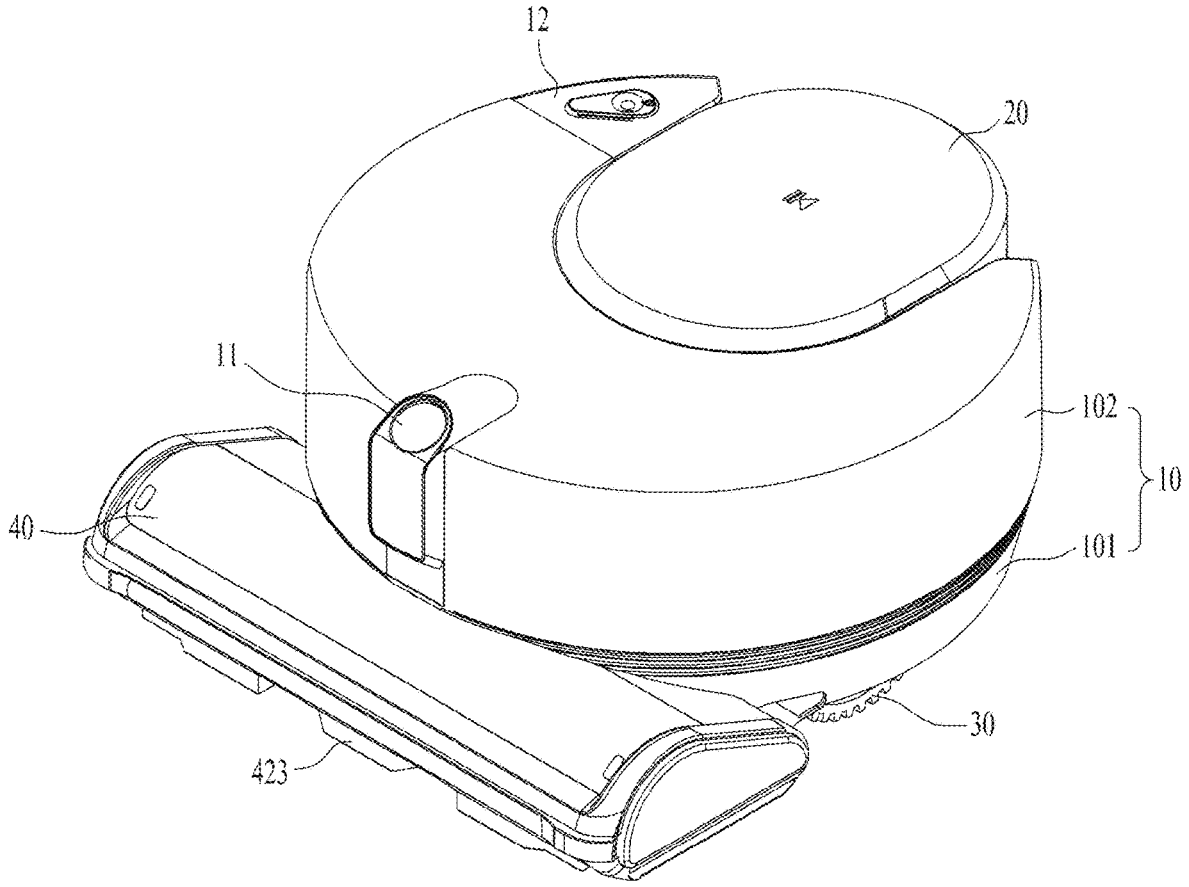
FIG. 1 is a perspective view of a robot cleaner according to an embodiment.

Hereinafter, specific embodiments of the present disclosure will be described with reference to the drawings. A following detailed description is provided to aid in a comprehensive understanding of a method, an apparatus, and/or a system described herein. However, this is only an example, and the present disclosure is not limited thereto.

In describing embodiments of the present disclosure, when it is determined that a detailed description of a known technology related to the present disclosure may unnecessarily obscure the subject matter of the present disclosure, a detailed description thereof will be omitted. In addition, terms to be described later are terms defined in consideration of functions in the present disclosure, which may vary depending on intention of a user or an operator, customs, or the like. Therefore, the definition thereof should be made based on the contents throughout the present specification. The terminology used in the detailed description is for the purpose of describing the embodiments of the present disclosure only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in the description, specify the presence of the certain features, numbers, steps, operations, elements, and portions or combinations thereof, but do not preclude the presence or addition of one or more other features, numbers, steps, operations, elements, and portions or combinations thereof.

FIG. 1 is a perspective view of a robot cleaner according to an embodiment. FIG. 2 is a bottom view of a robot cleaner according to an embodiment. Further, FIG. 3 is a side view of a robot cleaner according to an embodiment.

Hereinafter, a structure of a robot cleaner will be described with reference to FIGS. 1 to 3.

A robot cleaner 100 according to an embodiment may include a main body 10, a driving unit 30, a cleaning module housing 41, and a mopping unit 50. Further, the robot cleaner 100 may further include a battery (not shown) for providing electric power such that the above-described driver and mopping unit may be electrically driven.

The battery may be provided as a secondary battery and may be repeatedly charged and discharged. Thus, a user may use the robot cleaner by repeatedly charging the battery when a battery power level is low without having to replace or add a battery.

When the battery is provided as the secondary battery, the robot cleaner may further include a charging device (not shown) that may charge the robot cleaner.

In another example, the battery may be provided as a dry battery rather than the secondary battery. In this case, the dry battery may be required to be replaced when the dry battery is dead.

That is, there is no restriction on how the robot cleaner is provided with the electric power.

The main body 10 may be disposed to form an exterior of the robot cleaner 100.

The main body 10 may include a first housing 101 and a second housing 102.

The first housing 101 may form a portion of the main body 10 and may provide a space in which electronic components required for the robot cleaner 100 or parts required for the robot cleaner are mounted.

For example, a controller (not shown) that controls an operation of the robot cleaner 100 may be mounted in the first housing 101.

The controller determines whether to operate the driving unit 30 and whether to guide water received in a water tank 12, which will be described later.

Further, the first housing 101 may be disposed to provide a flow path (not shown) through which air containing dust is guided to the dust collector 20 to be described later. That is, the air sucked through the cleaning module 40 to be described later may be guided through an internal space of the first housing 101 to the dust collector 20.

The second housing 102 may be disposed in a form of a cover that covers the first housing 101. However, the second housing 102 is not limited thereto.

A display (not shown) may be disposed on one face of the second housing 102. The display may be formed in a shape of a touch panel, so that the user may simply enter a command through the display.

It is sufficient that the second housing 102 is disposed to be coupled to the first housing 101. For example, the second housing 102 may be hinged or integrally formed with the first housing 101.

However, it is preferable that the second housing 102 is separately disposed in consideration of installation convenience of the parts mounted in the first housing 101. The second housing 102 may prevent the parts mounted in the first housing 101 from being contaminated or damaged by an outside factor.

That is, the robot cleaner according to the present embodiment may be disposed such that the parts mounted in the first housing 101 are covered by the second housing 102 and not exposed to the outside. Thus, when the parts are operating, a user's body may be injured due to user's carelessness, malfunction, or the like. Thus, the main body 10 may cover the internal parts to prevent a safety accident. Further, because the main body 10 is present, a complex interior is not exposed to the outside, thereby creating a sense of beauty. Thus, the main body 10 may be used as a design element.

The cleaning module 40 may be a portion that is coupled to the main body of the robot cleaner 100 to perform the cleaning.

The cleaning module 40 may include a cleaning module housing 41 and the mopping unit 50.

The cleaning module 40 may be disposed to clean a traveling face. Specifically, the cleaning module 40 may be disposed to suck dust present on the traveling face.

The traveling face may be a floor face. When a carpet or the like is disposed, the traveling face may be a top face of the carpet.

The dust may be sucked into a space provided by the first housing 101 through the cleaning module housing 41. The sucked dust may be collected in the dust collector 20 and air from which the dust has been removed may be discharged to the outside of the main body 10.

The cleaning module housing 41 may be disposed to be coupled to the main body 10 to provide a space for accommodating the mopping unit 50 to be described later therein.

Further, the cleaning module housing 41 may provide a flow path through which the air containing the dust may be sucked such that the dust present on the traveling face may be removed.

The cleaning module housing 41 may include a first cleaning module housing 41*a* and a second cleaning module housing 41*b*.

Specifically, the first cleaning module housing 41*a* may provide the space for accommodating the mopping unit 50 therein as described above or a space for cleaning the traveling face.

The second cleaning module housing 41*b* may serve to securely connect the first cleaning module housing 41*a* to the main body 10.

Specifically, an external force may be applied to the robot cleaner 100 or an unexpected shock may occur on the robot cleaner 100 during the travel. In this connection, the first cleaning module housing 41*a* is firmly connected to the main body 10 by the second cleaning module housing 41*b*, so that a situation in which the first cleaning housing 41*a* deviates from an original position may be prevented.

In the drawing, the second cleaning module housing 41*b* is shown to be disposed at a lower side of the first housing 101, that is, a face facing the face to be cleaned, but is not limited thereto.

That is, there is no restriction on a connection relationship between the cleaning module housing 41 and the main body 10.

The robot cleaner 100 may include the driving unit 30.

The driving unit 30 may be disposed to move the main body 10.

The driving unit 30 may include a main wheel 31 and a driving motor 32.

The main wheel 31 may be disposed to be rotated by receiving electric power by the driving motor 32. Each main wheel 31 may be disposed on each of both sides of the main body 10.

A main wheel 31*a* disposed on one side and a main wheel 31*b* disposed on the other side may be controlled by different driver motors 32, respectively. That is, the main wheel 31*a* disposed on one side and the main wheel 31*b* disposed on the other side may be rotated at different rotational speeds.

Thus, the robot cleaner 100 may turn in a left or right direction. Further, the robot cleaner 100 may switch directions in combination with going straight or going backward.

That is, a travel speed of the robot cleaner 100 may be determined based on the rotational speed of the main wheel 31 and a travel direction may be determined by a difference in rotational speeds of the main wheels 31*a* and 31*b*.

For example, when the main wheel 31*a* on the left remains stationary and the main wheel 31*b* on the right is rotated, the robot cleaner 100 may turn to the left. When the main wheels 31*a* and 31*b* on the both sides are rotating, but when the main wheel 31*b* on the right rotates faster than the main wheel 31*a* on the left, the robot cleaner 100 may switch the direction to the left and continue moving straight.

The driving unit 30 may include auxiliary wheels 33 and 34. A first auxiliary wheel 33 may be disposed at or adjacent to a center of the robot cleaner 100. The first auxiliary wheel 33 is positioned adjacent to the center of the robot cleaner 100, thereby supporting a load of the robot cleaner 100 at the center of the robot cleaner 100 and simultaneously assisting the travel. Thus, shaking of the robot cleaner during the travel of the robot cleaner may be minimized.

The first auxiliary wheel 33 may be disposed to rotate as the travel direction of the robot cleaner 100 is switched.

Thus, the travel may be guided stably even when the robot cleaner 100 switches the direction while cleaning an area to be cleaned.

That is, the first auxiliary wheel 33 may assist the rotations of the main wheels 31*a* and 31*b* while supporting the robot cleaner 100.

A second auxiliary wheel 34 may be disposed in the cleaning module housing The cleaning module housing 41 is coupled to the main body 10 to perform the cleaning. The cleaning module housing 41 may be supported by the main body 10 while being coupled to the main body 10. In another example, a portion of the cleaning module housing 41 in contact with the traveling face (or a face to be cleaned) may receive a supporting force by the traveling face.

However, because the robot cleaner 100 performs the cleaning while essentially moving in a region to be cleaned, the cleaning module housing 41 may not move smoothly during the travel.

As the second auxiliary wheel 34 is disposed, the cleaning module housing 41 may be moved more smoothly during the travel of the robot cleaner 100.

Each second auxiliary wheel 34 may be disposed on each of both sides of the cleaning module housing 41 to perform a function of assisting balancing of the robot cleaner 100.

The dust collector 20 may be a portion where the dust is collected. The dust collector 20 may include a cyclone (not shown). The dust collector 20 may be in communication with the cleaning module 40.

The air may be introduced into the robot cleaner by the dust collector 20. When the air is sucked by the dust collector 20 and the air from which the dust has been removed is discharged to the outside, a negative pressure is generated in the robot cleaner 100, so that the air containing the dust may be introduced through the cleaning module housing 41.

The dust collector 20 may be formed in a form in which relatively large dust is primarily separated and then relatively small dust is secondarily separated. However, the dust collector 20 is not limited thereto and is sufficient when being able to suck the dust present on the traveling face.

The dust collector 20 may be disposed to be detachable from the main body 10. Thus, when the robot cleaner completes the cleaning or when excessive dust is accumulated in the dust collector 20, the user may easily separate the dust collector 20 to remove the dust, thereby ensuring convenience.

The sensor unit 11 may be disposed on the main body 10. The sensor unit 11 may provide image information such that the robot cleaner 100 may travel in the region to be cleaned.

That is, the sensor unit 11 may be a camera or a photographing sensor.

Specifically, the sensor unit 11 may collect information necessary for autonomous travel of the robot cleaner 100.

For example, the sensor unit 11 may include the photographing sensor that creates a travel map by photographing a periphery of the robot cleaner 100, an obstacle sensor that senses an obstacle, and the like. In another example, additional sensors may be further provided in addition to the above-described sensor.

For example, the sensor unit may include a wall sensor (not shown). Thus, information about the region to be cleaned may be input to the robot cleaner 100 through the wall sensor, the photographing sensor, and the like. The robot cleaner 100 may input a shape of a space while traveling, and divide the region to be cleaned through the wall sensor into a plurality of cleaning areas.

However, the present disclosure is not limited to the above-described example, and the above-described example is only one embodiment. The photographing sensor and the obstacle sensor may simultaneously perform wall sensing.

The photographing sensor may be disposed not only to sense the region to be cleaned, but also to specify a position of the main body 10 in the region to be cleaned that is previously input. Thus, a position of the space where the robot cleaner 100 performs the cleaning may be specified and the position of the robot cleaner 100 is specified, so that movement to a next cleaning area may be guided.

A type and the number of sensor units 11 are not limited. That is, a plurality of photographing sensors may be arranged, and when the plurality of photographing sensors are arranged, the plurality of photographing sensors may be photographing sensors of the same type or different types.

The robot cleaner 100 may vary a suction strength of the dust collector 20 based on a material of the floor. This is because when the dust collector 20 always sucks the dust at the same strength, it may be difficult to completely perform the cleaning on an unusual floor face such as the carpet and the like.

The robot cleaner 100 may include a floor sensor (not shown) to sense the material of the floor. The floor sensor may be a sensor that senses the material of the floor. The floor sensor may be disposed in the sensor unit 11 described above, or may be disposed at a position different from the sensor unit 11.

The region to be cleaned in which the robot cleaner 100 is used may vary depending on a case. For example, a floor material of the region to be cleaned may be marble or a floor paper. Further, the region to be cleaned may be made of a material other than the above example.

Depending on the material of the floor, an intensity at which the dust collector 20 is driven to effectively suck the dust may vary.

Specifically, the dust collector 20 must be driven more strongly in a carpeted region than on a general floor paper to effectively perform cleaning. The controller of the robot cleaner 100 may adjust the driving intensity of the dust collector 20 based on the type of floor material.

The obstacle sensor may determine whether an obstacle exists in the region to be cleaned. The obstacle sensor may be disposed integrally with the sensor unit 11 described above, or may be disposed separately. That is, the photographing sensor may also serve as the obstacle sensor.

As the obstacle sensor senses the obstacle, a travel path of the robot cleaner 100 may be changed. As a moving line becomes complicated, battery consumption may vary. Specifically, when the obstacle is present, the robot cleaner 100 is moved to bypass the obstacle. At this time, the moving line may be lengthened. As the moving line lengthens, a battery consumption for cleaning the corresponding area may increase.

FIG. 4 is a view showing a mopping unit of a robot cleaner according to an embodiment. Further, FIG. 5 is a view showing a connection relationship of a mopping unit of a robot cleaner according to an embodiment.

Hereinafter, the mopping unit will be described with reference to FIGS. 4 and 5.

The mopping unit 50 may include a body 52, a mopping roller 53, and a mop 54.

The mopping unit 50 is accommodated in the cleaning module housing 41 to clean the traveling face traveled by the robot cleaner 100.

Specifically, the mopping unit 50 may remove the dust and foreign substances while mopping the traveling face, aside from the dust being sucked into the robot cleaner 100 by the dust collector 20.

The dust present on the traveling face may not be completely removed by the suction of the dust collector 20. Thus, the mopping unit 50 is disposed to remove the dust remaining on the traveling face.

The mopping unit 50 may be accommodated in the space provided by the cleaning module housing 41 and may be combined with the cleaning module housing 41. Thus, the mopping unit 50 may be prevented from being displaced from the original position while mopping the floor.

The mopping unit 50 may include the body 52 disposed in the cleaning module housing 41. Specifically, the body 52 may be coupled to the cleaning module housing 41 to support the mopping unit 50.

Further, the body 52 is disposed such that the mop 54 to be described later may be coupled to the body 52 in a specific shape. The shape of the mop 54 may be determined based on a shape of the body 52.

The body 52 may be disposed such that a cross-section thereof is in a cross shape or in a + shape.

Specifically, the body 52 may extend in four directions from a mopping shaft 51 to be described later. Extended faces may have different thicknesses.

For example, extended faces extending in opposite directions may have the same thickness, and extended faces extending in neighboring directions may have different thicknesses.

The extended faces of the body 52 may be smoothly connected to each other. That is, all of the extended faces may be arranged to have the + shape as a whole, but neighboring extended faces may be connected to each other smoothly.

When the neighboring extended faces are smoothly connected to each other, the mopping roller 53 to be described later may be naturally seated.

The body 52 doesn't necessarily need to extend in up, down, left, and right directions on the basis of a side cross-sectional view of the cleaning module housing 41. For example, the body 52 may extend in a form of an X.

That is, the body 52 is sufficient when being disposed in a shape in which the mop 54 to be described below is capable of being in a surface contact with a floor face. The body 52 is sufficient when being disposed to provide a space in which four or more mopping rollers 53 are seated such that the mop 54 is stably in a surface contact with the traveling face.

The body 52 may be coupled to the cleaning module housing by the mopping shaft 51. The mopping shaft 51 may connect the body 52 with the cleaning module housing 41 at a center or a position adjacent to the center of the body 52.

The mopping shaft 51 may serve to transmit power generated from a mopping unit driver 43 disposed in the cleaning module housing 41 to the mopping unit 50.

The mopping roller 53 may be disposed on the body 52. Specifically, as described above, the body 52 may be disposed to have the + shape in which the neighboring extended faces are smoothly connected to each other. The mopping roller 53 may be disposed between the two neighboring extended faces of the body 52.

That is, a plurality of mopping rollers 53 may be arranged on the body.

At least one of the mopping rollers 53 may receive the power by the mopping shaft 51 to rotate the mop 54 to be described later. A specific process in which the power is transmitted will be described later.

Among the mopping rollers 53, a mopping roller 53*a* receiving the power directly by the mopping shaft 51 may be formed in a gear shape. On the other hand, the mopping roller 53 that does not directly receive the power by the mopping shaft 51 may be formed in a cylindrical shape to assist the mop 54 to move along the body 52 and the mopping roller 53.

The mopping rollers 53 may be arranged such that rotation centers thereof are respectively positioned on line segments of a virtual rectangle. Accordingly, when the mop 54 is disposed to surround the mopping roller 53 and the body 52, the mop 54 may have a shape of a rectangle with rounded apices.

In other words, the mopping unit 50 may be formed in a shape similar to a caterpillar. The mopping roller 53 may serve as a wheel and the mop 54 may serve as a belt. Because the body 52 is formed in a shape extending in the four directions and each mopping roller 53 is disposed between the two extended faces of the body 52, four mopping rollers 53 may be arranged. Thus, the mop 54 is disposed to move when the mopping unit 50 is operated, thereby performing the cleaning.

The mop 54 may be made of a material that may contain moisture. This is to maximize an effect of the cleaning by receiving the moisture by a water supply passage 121 to be described later.

The mop 54 may be disposed to be detachable from the body 52. The user may or may not wish to mop when using the robot cleaner. Thus, it is preferable that the mop 54 is able to be detached from the robot cleaner 100 based on selection of the user.

Further, when the mop 54 is formed integrally with the robot cleaner 100, after the cleaning, the mop 54 in a contaminated state has to be reused. Further, even when the mop 54 is cleaned, there may be difficulties in the cleaning due to a structure of the robot cleaner 100. Thus, the mop 54 is preferably detachable.

There is no restriction on how the mop 54 surrounds the body 52 and the mopping roller 53.

For example, both ends of the mop 54 may be repeatedly attached to or detached from each other, or a component for mounting the mop 54 on the body 52 may be additionally disposed.

That is, there is no restriction on a scheme of connecting the mop 54 with the body 52.

As described above, when the mop 54 is disposed to surround the body 52 and the mopping roller 53, the mop 54 may have the shape of the rectangle with the rounded apices.

Accordingly, unlike a case where the mop 54 is formed in a cylindrical shape, an area of the mop 54 in contact with the ground may be increased. Because the area of the mop 54 in contact with the ground increases, the cleaning may be effectively performed.

Specifically, when the mop is formed in the cylindrical shape, the floor and the mop come into a line contact with each other.

On the other hand, the mop 54 of the robot cleaner 100 according to the present embodiment is disposed to be in the surface contact with the traveling face, so that a cleaning effect is superior compared to the case where the mop is formed in the cylindrical shape.

The mopping unit 50 may include a mopping cover 55. A hole may be defined at one side of the mopping unit 50 such that the mopping shaft 51 protrudes, and the mopping roller 53 and the body 52 may not be exposed to the outside at the other side of the mopping unit 50.

As the mopping cover 55 is included, the foreign substance may be prevented from being caught when the robot cleaner 100 performs the cleaning. This is because the operation of the mopping unit 50 may not be smooth when the foreign substance enters the mopping unit 50.

The mopping unit 50 may be seated on the mopping unit receiving portion 42. The mopping unit receiving portion 42 may be formed as a portion of the cleaning module housing 41 or may be mounted inside the cleaning module housing.

The mopping unit receiving portion 42 may include a mopping unit receiving portion housing 420. The mopping unit receiving portion housing 420 may provide a receiving space 421 therein to accommodate the mopping unit 50 therein.

A through hole 420*a* may be defined at one side of the mopping unit receiving portion 42 such that the mopping unit 50 may be accommodated and the mopping shaft 51 may be connected to the cleaning module housing 41.

The mopping unit receiving portion 42 may include a mop sensing portion 422 that determines whether the mop 54 surrounds the body 52 and the mopping roller 53. When the mop sensing portion 422 determines whether the mop 54 is mounted, whether to supply water toward the mop 54 may be determined.

A climbing preventing portion 423 may be disposed on the mopping unit receiving portion 42. The climbing preventing portion 423 may extend forwardly of the cleaning module housing 41. The climbing preventing portion 423 is disposed to prevent a movement to a stepped terrain.

The climbing preventing portion 423 may extend forwardly of the robot cleaner 100 at a portion where the mopping unit receiving portion 42 and the traveling face are in contact with each other.

In other words, the climbing preventing portion 423 may extend in the travel direction of the robot cleaner 100 from a face of the mopping unit receiving portion 42 facing the traveling face.

The climbing preventing portion 423 may protrude outwardly of the cleaning module housing 41. Specifically, the climbing preventing portion 423 may protrude forwardly of the cleaning module housing 41. More specifically, the climbing preventing portion 423 may protrude forwardly of a portion of the cleaning module housing 41 adjacent to the traveling face.

The climbing preventing portion 423 prevents the robot cleaner 100 from entering an area that is not the same height as the traveling face such as a carpet and the like during the traveling.

In general, the robot cleaner is used in a space where a height of the traveling face is constant except in unusual cases in a home, a company, and the like. Even when the robot cleaner is used in the space where the height of the traveling face is constant, there may be cases where the carpet is laid or a threshold or the like is formed depending on a user's preference.

Because the robot cleaner 100 according to the present embodiment is capable of traveling while mopping, it is not desirable that the mop 54 is operated while the robot cleaner 100 travels on a top face of the carpet or the like.

A plurality of climbing preventing portions 423 may be arranged on the mopping unit receiving portion 42. Thus, climbing may be prevented not only when the robot cleaner 100 encounters a portion having a different height of the traveling face while moving straight, but also when the robot cleaner 100 encounters a portion having a different height of the traveling face while moving in a certain direction. Thus, the operation of the mop 54 may not be disturbed by the traveling face.

The mopping unit 50 may be detached from the cleaning module housing 41. As shown in FIG. 5, the mopping unit 50 may receive the power because the mopping shaft 51 is connected to the cleaning module housing 41.

The mopping unit driver 43 may be disposed in the cleaning module housing 41. The mopping unit driver 43 may include a power supply 430 for generating the power and a power transmitter 431 for transmitting the power.

The power supply 430 may be formed as a motor to generate a rotational force. In FIG. 5, the power supply 430 is formed in an annular shape with projections, but is not limited thereto.

However, it is preferable to at least rotate the mopping shaft 51 to transmit the rotational force.

The power transmitter 431 serves to transmit the power generated by the power supply 430 to the mopping unit 50. The power transmitter 431 may be coupled to the mopping shaft 51.

The power transmitter 431 may be formed in a shape corresponding to a shape of the mopping shaft 51. Thus, the power generated from the power supply 430 may be transmitted to the mopping unit 50 while being maintained as much as possible.

The mopping shaft 51 may include a first gear 51*a*. As the mopping shaft 51 is rotated, the first gear 51*a* may also be rotated integrally with the mopping shaft 51.

The first gear 51*a* may be connected to the mopping roller 53*a* that directly receives the power by the mopping shaft 51 or may be connected to a second gear 51*b* that is connected to the mopping roller 53*a*.

That is, when the mopping shaft 51 is rotated, the first gear 51*a* is rotated, and as the first gear 51*a* is rotated, the mopping roller 53*a* or the second gear 51*b* may be rotated.

When the mopping roller 53*a* receiving the power from the power supply 430 is rotated, the mop 54 may be rotated. Thus, the mop 54 may be rotated while maintaining surface contact with the traveling face (or the floor face).

Thus, the mop 54 may mop the traveling face and then move along a side face and a top face of the mopping unit 50, and then the side face may move toward the traveling face. Accordingly, because a relatively clean face of the mop 54 is sequentially moved to be in surface contact with the traveling face, a cleaning effect may be increased.

FIG. 6 is a cross-sectional view of a cleaning module according to an embodiment. Further, FIG. 7 is a view showing a water supply passage of a robot cleaner according to an embodiment. Further, FIG. 8 is a view of a water supply structure of a robot cleaner according to an embodiment.

Hereinafter, a water supply structure of the robot cleaner will be described with reference to FIGS. 6 to 8.

The robot cleaner 100 according to the present embodiment may include the water tank 12. The water tank 12 may form the exterior of the robot cleaner 100 together with the main body 10. The water tank 12 may serve to increase the cleaning effect by receiving water therein and moistening the mop 54 to be described later.

When the mop 54 is mounted by the controller, the water in the water tank 12 is guided toward the cleaning module housing 41 and may be sprayed toward the mop 54.

Specifically, an interior of the cleaning module housing 41 may be in communication with the water supply passage 121 such that the water contained in the water tank 12 may be supplied. The water received in the water tank 12 may be flowed toward the cleaning module housing 41 along the water supply passage 121.

The water supply passage 121 may be formed in a form of a nozzle or a tube. When the water supply passage 121 approaches the cleaning module housing 41, the water supply passage 121 may branch to both sides based on a size of the cleaning module housing 41 and sprayed toward the mopping unit 50.

Because the cleaning module housing 41 provides a space for receiving the mopping unit 50 therein, the cleaning module housing 41 may be formed in a shape different from the main body 10 of the robot cleaner 100. Thus, in order to moisten the mop 54 evenly, it is preferable that the water supply passage 121 is disposed at various places inside the cleaning module housing 41.

That is, it is shown in the drawing that a water supply passage 121*a* is disposed on one side and a water supply passage 121*b* is disposed on the other side, but the present disclosure is not limited thereto.

However, when too many water supply passages 121 are arranged, a water pressure may be lowered at each water supply passage.

The water discharged through the water supply passage 121 does not simply moisten the mop 54 in a form of water. The water is sprayed when being discharged from the cleaning module housing 41 to a space where the mopping unit 50 is positioned, so that the water may be absorbed into the mop 54 as evenly as possible.

Because the mop 54 is formed in the shape similar to the rectangle, when the water is sprayed from a rear side of the cleaning module housing 41, the water is difficult to be evenly absorbed in an entirety of the mop 54. However, because the mop 54 is rotated, the water is preferably sprayed and evenly dispersed.

As the mop 54 is moistened with the water, the cleaning may be performed more neatly.

The water tank 12 is connected to the water supply passage 121 to guide the water to the cleaning module housing 41. The water tank 12 may be coupled to the main body to form the exterior of the robot cleaner 100 together with the main body 10.

The water contained in the water tank 12 may not be guided toward the cleaning module housing 41 by only a self-load of the water in the water tank 12. Thus, in order to smoothly guide the water in the water tank 12 toward the cleaning module housing 41, a pump 122 may be included.

The pump 122 may be positioned on the water supply passage 121. The pump 122 may provide a driving power to the water such that the water in the water tank 12 may be continuously sprayed into the mop 54.

The pump 122 may be formed as a diaphragm pump. However, the pump 122 is not limited thereto.

The robot cleaner 100 according to an embodiment may include a pump motor 123 that operates the pump 122.

The pump 122 and the pump motor 123 may be mounted in the main body 10. That is, the pump 122 and the pump motor 123 may be mounted in the main body 10 without harming an appearance of the exterior.

The water flowed from the pump 122 may be guided to the cleaning module housing 41 along the water supply passage 121 formed inside the main body 10 and sprayed from the cleaning module housing 41 to be evenly dispersed and absorbed in the mop 54.

Accordingly, the mop 54 is disposed to mop the traveling face in a wet state, so that a cleaning efficiency may be increased.

Although the exemplary embodiments of the present invention have been described above in detail, those of ordinary skill in the art to which the present disclosure pertains will appreciate that various modifications are possible within the limits without departing from the scope of the present disclosure for the above-described embodiments. Therefore, the scope of the present disclosure should not be limited to the described embodiments, and should be determined not only by the claims to be described later, but also by the equivalents of the claims.

The invention claimed is:

1. A robot cleaner comprising:

a main body for forming an exterior of the robot cleaner;

a driving unit configured to move the main body;

a cleaning module housing coupled to the main body; and a mopping unit accommodated in a space defined in the cleaning module housing and configured to mop a traveling face, wherein the mopping unit includes:

a body disposed in the cleaning module housing and extending in a crosswise direction from a rotation center of the body;

a plurality of mopping rollers arranged on the body and respectively arranged in spaces divided by the body; and a mop disposed to surround the body and the plurality of mopping rollers and configured to be in a surface contact with the traveling face, wherein the plurality of mopping rollers are arranged such that centers of the mopping rollers are positioned on line segments of a virtual rectangle, and wherein at least one of the plurality of mopping rollers are disposed to rotate the mop.

2. The robot cleaner of claim 1, further comprising:

a water tank configured to receive water therein, wherein the water tank is coupled to the main body; and a water supply passage connected to the water tank and the cleaning module housing and configured to guide the water received in the water tank.

3. The robot cleaner of claim 2, wherein the water supply passage is disposed to guide water to an internal space of the cleaning module housing, and wherein the water supply passage and the cleaning module housing are in communication with each other in at least one location.

4. The robot cleaner of claim 3, further comprising:

a pump configured to guide water received in the water tank to the cleaning module housing; and a pump motor configured to operate the pump, wherein the pump and the pump motor are connected to the main body.

5. The robot cleaner of claim 1, wherein each mopping roller is disposed between two neighboring extended faces among extended faces of the body.

6. The robot cleaner of claim 5, wherein the plurality of mopping rollers are spaced apart from each other.

7. The robot cleaner of claim 1, further comprising:

a mopping unit receiving portion coupled to the cleaning module housing, wherein the mopping unit receiving portion seats the mopping unit therein; and a mopping unit driver disposed in the cleaning module housing, wherein the mopping unit driver operates the mopping unit.

8. The robot cleaner of claim 7, wherein the mopping unit further includes a mopping shaft disposed to penetrate the mopping unit receiving portion and configured to receive a driving power for rotating the mop, and wherein the mopping shaft is connected to the mopping unit driver and configured to receive the driving power to rotate the mop.

9. The robot cleaner of claim 8, wherein a first gear rotated integrally with the mopping shaft is directly connected to a mopping roller for rotating the mop among the plurality of mopping rollers or is connected to a second gear connected to the mopping roller for rotating the mop among the plurality of mopping rollers.

10. The robot cleaner of claim 8, further comprising:

a controller configured to determine whether to operate the mopping unit driver and whether to guide water received in a water tank, and wherein water received in the water tank is controlled to be sprayed toward the mop when the mop is mounted.

11. The robot cleaner of claim 8, wherein the mopping unit receiving portion includes a climbing preventing portion extending forward of the cleaning module housing to prevent the robot cleaner from moving to a stepped terrain.

12. The robot cleaner of claim 11, wherein the climbing preventing portion extends from a face of the mopping unit receiving portion facing the traveling face in a direction of travel.

13. The robot cleaner of claim 11, wherein the climbing preventing portion defines a plurality of climbing preventing portions.

* * * * *